US012123675B1

(12) United States Patent
Dungan

(10) Patent No.: US 12,123,675 B1
(45) Date of Patent: Oct. 22, 2024

(54) PINNED TAB GAS BLOCK

(71) Applicant: John Dungan, Muskogee, OK (US)

(72) Inventor: John Dungan, Muskogee, OK (US)

( * ) Notice: Subject to any disclaimer, the term of this patent is extended or adjusted under 35 U.S.C. 154(b) by 0 days.

(21) Appl. No.: 18/452,649

(22) Filed: Aug. 21, 2023

(51) Int. Cl.
*F41A 5/28* (2006.01)
*F41A 5/26* (2006.01)

(52) U.S. Cl.
CPC . *F41A 5/28* (2013.01); *F41A 5/26* (2013.01)

(58) Field of Classification Search
CPC .. F41A 5/26; F41A 5/28; F16B 39/101; F16B 35/005
See application file for complete search history.

(56) References Cited

U.S. PATENT DOCUMENTS 1,595,175 A * 8/1926 Vosen ..... F16B 39/20 411/974
2,043,993 A * 4/1951 Erling ..... F16B 35/005 411/929
2,549,823 A * 1/1973 Kost ..... F16B 35/005 411/393
3,710,490 A * 1/1973 Cornett ..... F41A 17/44 42/70.11
4,531,321 A * 7/1985 Bechtel ..... F41G 11/003 42/126
5,690,290 A * 11/1997 Asano ..... F16B 39/10 242/283
8,596,185 B1 * 12/2013 Soong ..... F41A 5/28 89/193
2007/0206989 A1 * 9/2007 Wagner ..... E04F 11/1836 403/292
2007/0269290 A1 * 11/2007 Chang ..... A47B 91/04 411/548
2010/0282066 A1 * 11/2010 Tankersley ..... F41G 11/003 42/108
2014/0076149 A1 * 3/2014 Adams ..... F41A 5/28 89/192
2015/0253091 A1 * 9/2015 Gardner ..... F41A 5/20 89/193
2017/0122358 A1 * 5/2017 Kito ..... F16B 35/005
2017/0336159 A1 * 11/2017 Kitchen ..... F41A 5/26
2018/0328684 A1 * 11/2018 Brinson ..... F41A 5/28

FOREIGN PATENT DOCUMENTS

DE 2245042 A1 * 3/1974
KR 100757359 B1 * 9/2007
KR 20150115411 A * 10/2015

* cited by examiner

*Primary Examiner* — Gabriel J. Klein
(74) *Attorney, Agent, or Firm* — John Dungan

(57) ABSTRACT

The present invention is a gas block for use with a firearm that includes a tab covering the set screws and held in place by a pin that runs through the gas block body. The gas block body includes a slot around each set screw hole that allows the tab to be inserted into the gas block body. The tab provides several benefits over traditional gas block designs, including preventing the set screws from shifting or rotating during firing and allowing for easy installation and removal of the gas block without the need for specialized tools. The gas block is easily installed and removed, and the tab provides a secure and stable attachment point for the gas block. This gas block is an improvement in the field of rifle technology and is expected to find use in the firearms industry.

11 Claims, 4 Drawing Sheets

PINNED TAB GAS BLOCK

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A LARGE TABLE, OR A COMPUTER PROGRAM LISTING APPENDIX ON READ-ONLY OPTICAL DISC

Not Applicable

BACKGROUND OF THE INVENTION

Field of the Invention

The invention pertains to Firearms. More specifically, a gas block for gas operated firearms.

Description of Related Art

A number of firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semi-automatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port. As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber. The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Traditionally, the gas block of a firearm is attached to the barrel using pins, set screws or a clamp mount system. Set screw and clamp mount system designs can be problematic because the gas block can shift or rotate during firing, which can cause a number of issues, including reduced accuracy, increased wear and tear on the rifle, and potential safety concerns. Additionally, the process of attaching and aligning the gas block using pins can be time-consuming and requires specialized tools, making it difficult for novice gun owners to properly secure the gas block to their rifles.

Therefore, there is a need for an improved gas block design that addresses these issues and provides increased accuracy and reliability while also being easy to install and maintain. The present invention seeks to address these needs by providing a firearm gas block that can be easily installed and removed without specialized tools, while also providing a secure and stable attachment to the barrel.

BRIEF SUMMARY OF THE INVENTION

The present invention relates to an improved gas block for use with a firearm. The gas block comprises a body having one or more set screw holes for attachment to the rifle's barrel. The gas block further comprises a tab that covers the set screws, which is held in place by a pin that runs through the gas block body.

The gas block body includes a slot around the one or more set screw holes that allows the tab to be inserted into the gas block body. The tab is designed to be easily removable, allowing for quick and easy access to the set screws for maintenance or adjustment. The pin that holds the tab in place runs through the gas block body, ensuring that the tab remains in place during firing.

The tab provides several benefits over traditional gas block designs. First, it prevents the set screws from shifting or rotating during firing, which can cause a loss of accuracy or potential safety issues. Second, the tab allows for easy installation and removal of the gas block without the need for specialized tools. Finally, the slot around the set screw holes provides a secure and stable attachment point for the tab, ensuring that it remains in place during use.

Overall, the present invention provides an improved gas block design for firearms that is easy to use, provides secure attachment for the tab, and prevents the set screws from shifting or rotating during firing.

DETAILED DESCRIPTION OF THE INVENTION

Figure 1:
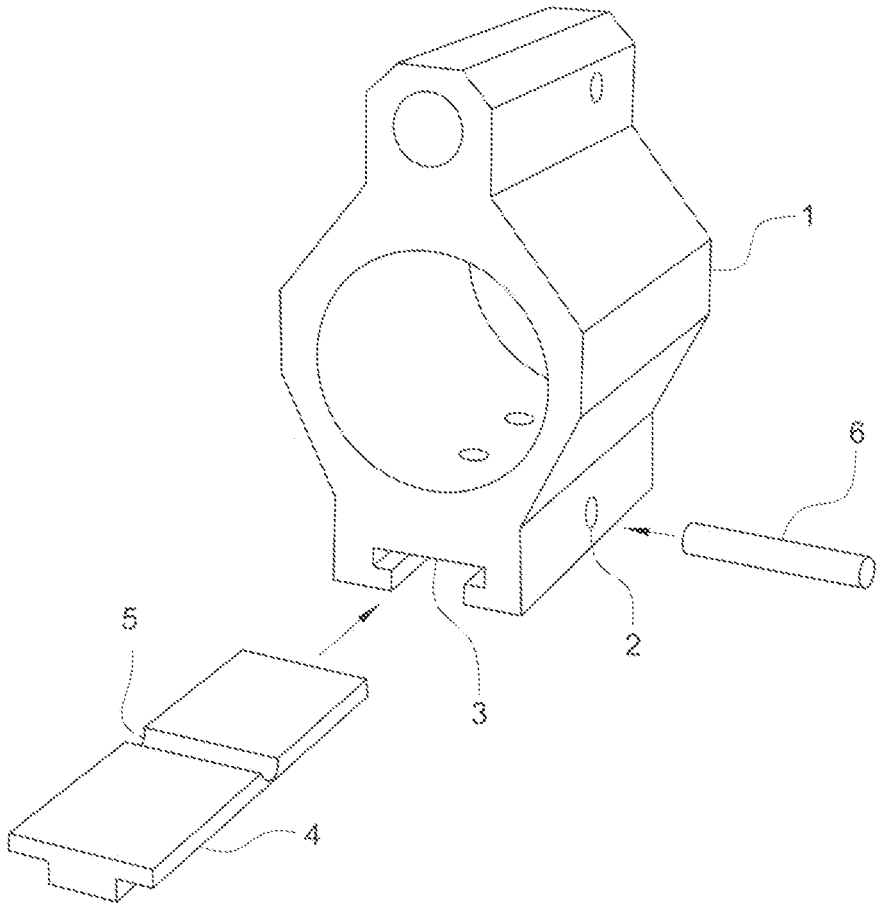
FIG. 1—Pinned Tab Gas Block Body with Tab and Pin—Side 1 and Rear Face
Figure 2:
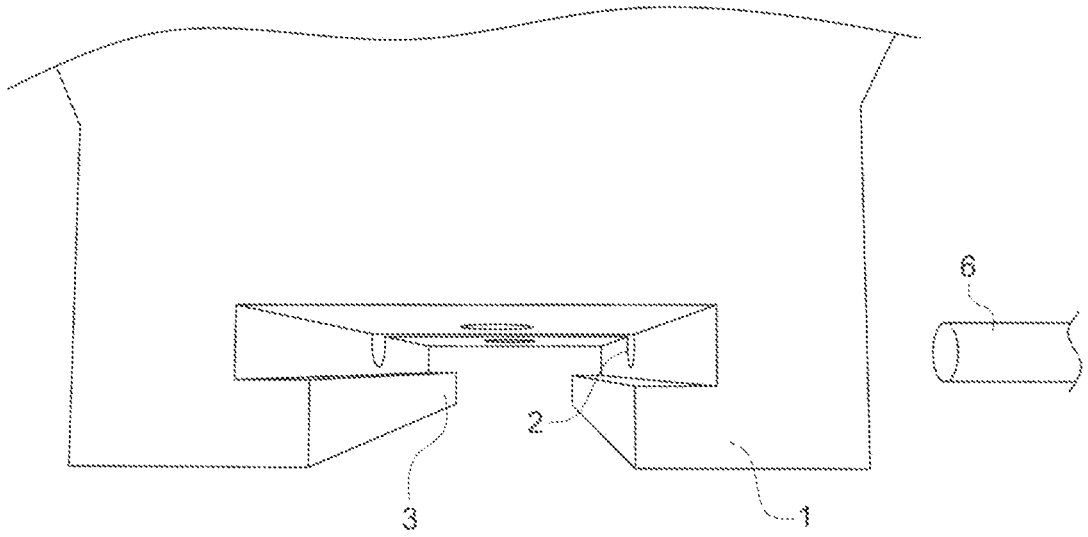
FIG. 2—Pinned Tab Gas Block Body Tab Slot—Rear Face
Figure 3:
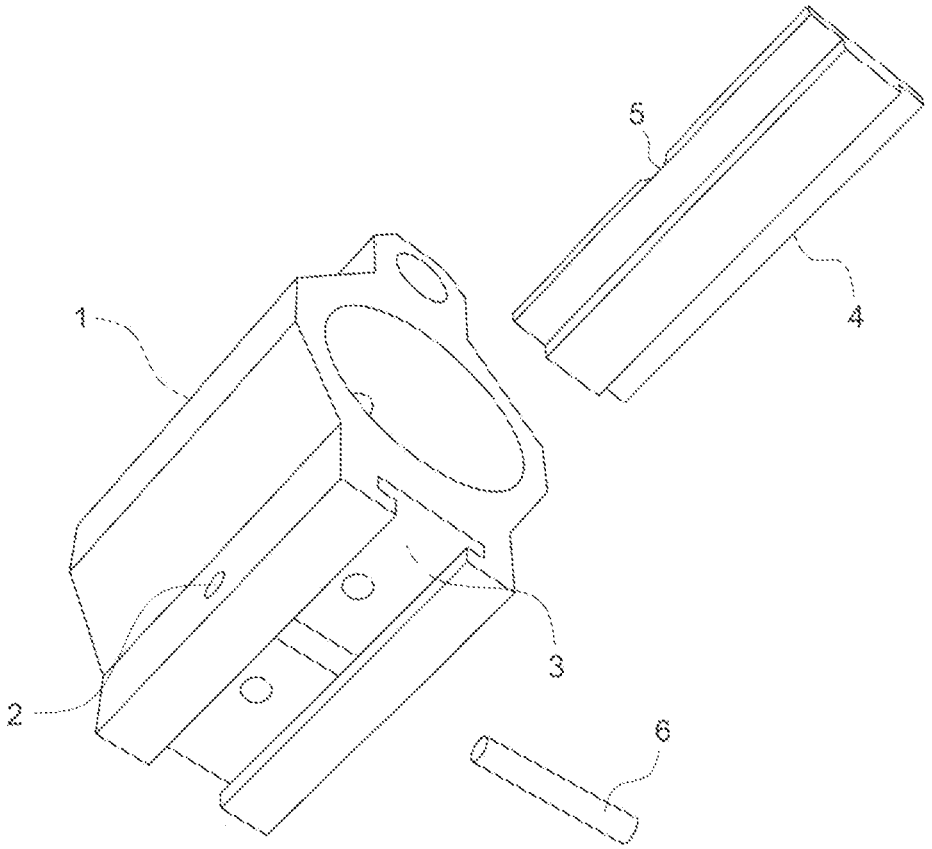
FIG. 3—Pinned Tab Gas Block Body with Tab and Pin—Bottom and Side 2
Figure 4:
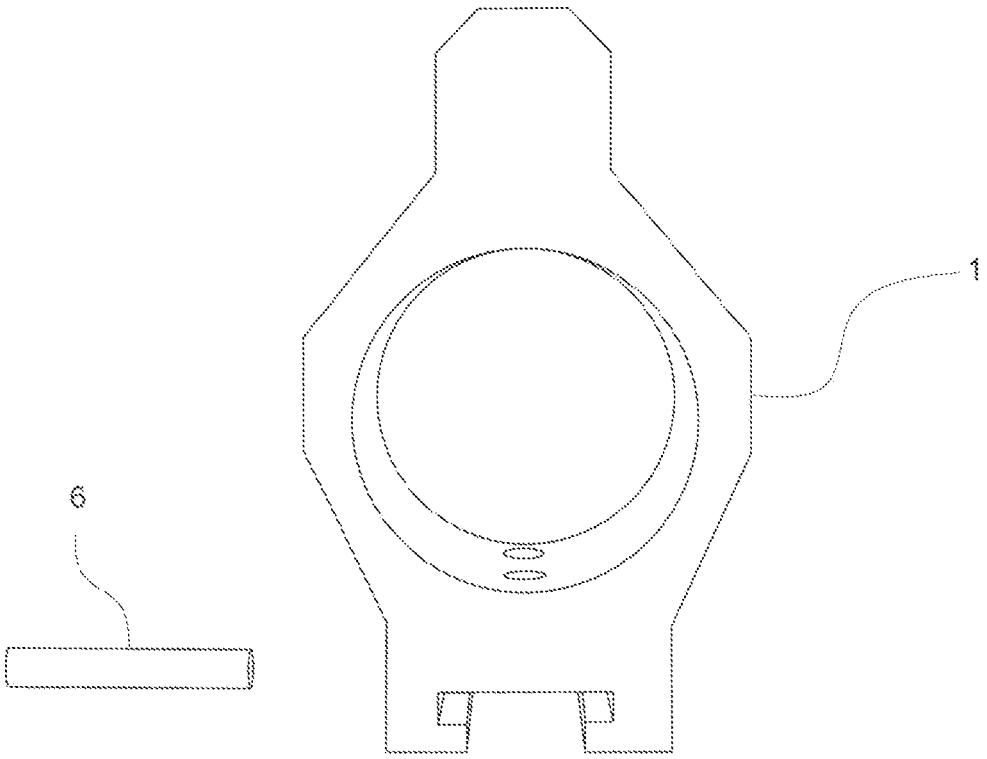
FIG. 4—Pinned Tab Gas Block Body with Pin—Front Face

The present invention is an improved gas block for use with a firearm. The gas block comprises a body 1 having a plurality of set screw holes for attachment to the rifle's barrel. The gas block is positioned over the barrel and secured to it using set screws (not shown) that are inserted through the set screw holes.

The gas block further comprises a tab 4 that covers the set screws. The tab 4 is designed to be easily removable, allowing for quick and easy access to the set screws for maintenance or adjustment. The tab 4 is positioned over the set screws and held in place by a pin 6 that runs through the gas block body 1. The pin 6 is secured to prevent the tab 4 from becoming dislodged during firing.

The gas block body 1 includes a slot 3 around the set screw holes that allows the tab 4 to be inserted into the gas block body 1. The slot 3 provides a secure and stable attachment point for the tab 4, ensuring that it remains in place during use. The tab 4 is inserted into the slot 3, and the pin 6 is inserted through the pin holes 2 in the gas block body 1 and the pin groove 5 in the tab 4 to secure it in place.

The gas block can be easily installed and removed without the need for specialized tools. To install the gas block, the set screws are inserted through the set screw holes and tightened to secure the gas block to the barrel. The tab 4 is then inserted into the slot 3, and the pin 6 is inserted through the pin holes 2 in the gas block body 1 and the pin groove 5 in the tab 4 to secure it in place.

To remove the gas block, the pin 6 is removed, and the tab 4 is pulled out of the slot 3. The set screws can then be accessed for maintenance or adjustment, and the gas block can be easily reinstalled by reversing the installation process.

The tab 4 provides several benefits over traditional gas block designs. First, it prevents the set screws from shifting or rotating during firing, which can cause a loss of accuracy or potential safety issues. Second, the tab 4 allows for easy installation and removal of the gas block without the need for specialized tools. Finally, the slot 3 around the set screw holes provides a secure and stable attachment point for the tab 4, ensuring that it remains in place during use.

In summary, the present invention provides an improved gas block design for firearms that is easy to use, provides a secure attachment point for the tab 4, and prevents the set screws from shifting or rotating during firing. The gas block is easily installed and removed without the need for specialized tools, and the tab 4 provides a secure and stable attachment point for the gas block.

The invention claimed is:

1. A gas block for use with a firearm, comprising:

a gas block body having a set screw hole configured to facilitate attachment to a barrel of a rifle;

a tab that covers a set screw in the set screw hole, the tab being held in place by a pin that runs through the gas block body;

wherein the tab prevents the set screw from shifting or rotating during firing; and a slot around the set screw hole that allows the tab to be inserted into the gas block body;

wherein the slot provides a secure and stable attachment point for the tab and allows for installation and removal of the tab without the need for specialized tools.

2. The gas block of claim 1, wherein the gas block body is made of steel, titanium, or aluminum.

3. The gas block of claim 1, wherein the tab is secured to the gas block by a hinge.

4. The gas block of claim 1, wherein the gas block body is formed from a rigid material.

5. The gas block of claim 1, wherein the pin that holds the tab in place is removable to facilitate cleaning and maintenance of the gas block.

6. The gas block of claim 1, further comprising an port adjustment mechanism that allows the user to adjust the amount of gas that is directed back into the rifle.

7. The gas block of claim 1, further comprising a coating or plating applied to the gas block to resist corrosion and wear.

8. The gas block of claim 1, wherein the gas block body includes a plurality of set screw holes, and the tab is configured to cover at least one of the set screw holes.

9. The gas block of claim 1, wherein the tab comprises a mechanism meant to supply is configured to supply tension to the set screw.

10. A method of using a gas block for a firearm, comprising:

positioning the gas block over a barrel of a rifle;

securing the gas block to the barrel using at least one set screw inserted through a set screw holes in a gas block body;

inserting a tab into a slot in the gas block body around the set screw hole to cover the at least one set screw;

securing the tab in place using a pin that runs through the gas block body; and removing the tab to access the at least one set screw for maintenance or adjustment to the gas block.

11. The method of claim 10, wherein the tab is configured to provide tension to the at least one set screw to prevent the at least one set screw from becoming dislodged.

* * * * *